US008678364B2

(12) United States Patent
Watts

(10) Patent No.: US 8,678,364 B2
(45) Date of Patent: Mar. 25, 2014

(54) PRECISION LEVELING VICE

(75) Inventor: Matthew L. Watts, Lenoir City, TN (US)

(73) Assignee: DENSO Manufacturing Tennessee, Maryville, TN (US)

( * ) Notice: Subject to any disclaimer, the term of this patent is extended or adjusted under 35 U.S.C. 154(b) by 308 days.

(21) Appl. No.: 13/070,301

(22) Filed: Mar. 23, 2011

(65) Prior Publication Data

US 2012/0242024 A1 Sep. 27, 2012

(51) Int. Cl.
*B25B 1/22* (2006.01)

(52) U.S. Cl.
USPC ..... 269/59; 269/71; 269/75

(58) Field of Classification Search
USPC ..... 269/43, 45, 95, 246, 236, 229, 247, 269/291, 289 R, 75, 71, 76
See application file for complete search history.

(56) References Cited

U.S. PATENT DOCUMENTS 4,418,901 A * 12/1983 Woods et al. ..... 269/71

* cited by examiner

*Primary Examiner* — Lee D Wilson
*Assistant Examiner* — Nirvana Deonauth
(74) *Attorney, Agent, or Firm* — Harness, Dickey & Pierce, P.L.C.

(57) ABSTRACT

A precision leveling vice includes a vice body having a fixed jaw and an end wall. A moving jaw moves toward or away from the fixed jaw to frictionally retain or release a member. The vice assembly is connected to a swivel plate. A fixture plate is positioned oppositely about the swivel plate with respect to the vice assembly. A pivot pin is positioned in a partial circular slot of each of the swivel plate and fixture plate permitting the swivel plate and vice assembly to move in a rocking motion with respect to the fixture plate by rotation about the pivot pin. First and second adjustment fasteners positioned in through apertures at swivel plate opposite ends threadably engage the fixture plate. Opposite axial rotation of the first and second adjustment fasteners causes a head of one of the adjustment fasteners to contact the swivel plate inducing the rocking motion.

18 Claims, 4 Drawing Sheets

FIG 4
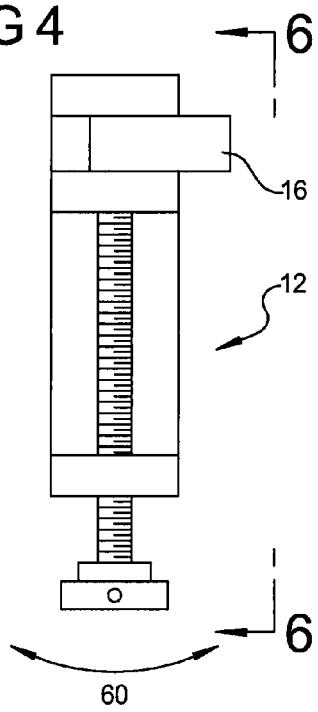
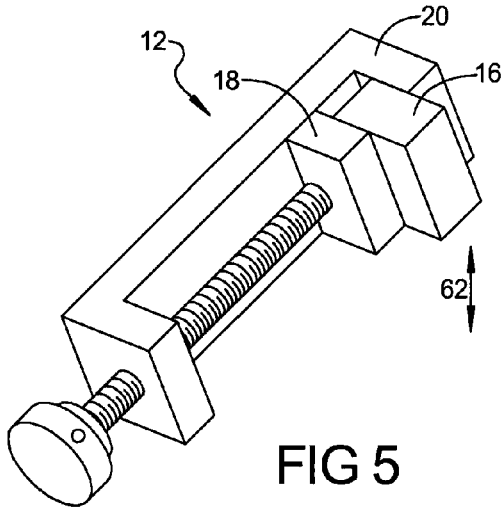
FIG 5
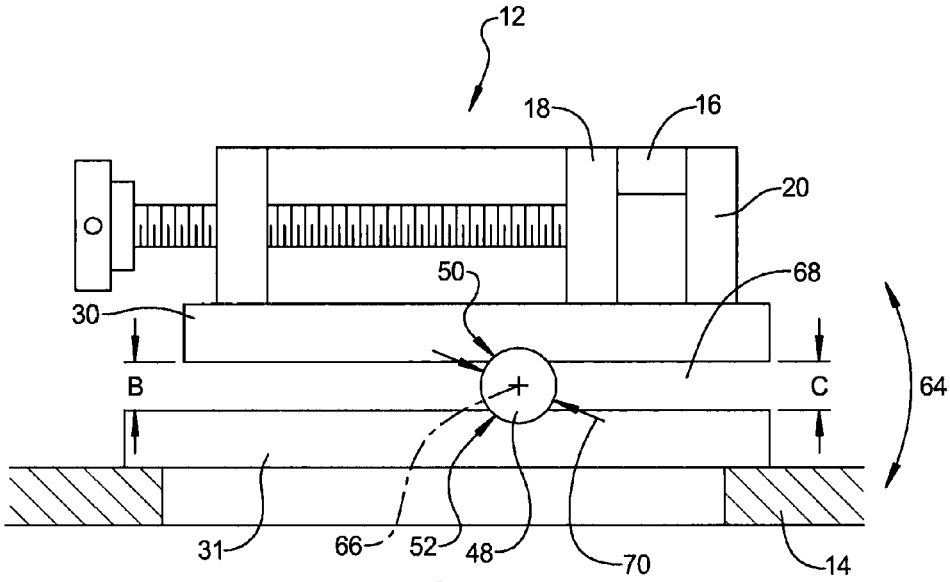
FIG 6

PRECISION LEVELING VICE

FIELD

The present disclosure relates to vices used in machining operations to retain and adjust a position of a member during a machining operation.

BACKGROUND

This section provides background information related to the present disclosure which is not necessarily prior art.

Vices used for clamping a part or member for operations such as machining, lancing, cutting, plasma cutting, electrical discharge machining (EDM) or the like operations conducted on the member by an operating device commonly include a movable clamp portion and a fixed clamp portion. The member is retained between the movable and fixed clamp portions by frictional contact with the movable and fixed clamp portions, and a compression force provided through the movable clamp portion. The member is initially aligned and measured multiple times to ensure a predetermined orientation with respect to the operating device. Disadvantages of common vices include the member moving from its retained position during the operation by forces exerted from the operating device.

Common vices permit the member to be aligned in two axes with respect to a bed or support and the operating device, a first axis provided by rotation/displacement of the vice and a second axis provided by use of the movable and fixed clamp portions. Adjustment of the vice to correct for perpendicularity or parallelism requires movement of the vice in a third axis. A common method of providing movement in the third axis is to add one or more shims under all or a portion of the vice to adjust a height or angle of the vice, therefore changing a height or angle of the member with respect to the operating device. Use of shims are a repetitive and time consuming operation, because multiple shims are often placed or replaced until the desired orientation of the member is achieved. Use of shims also commonly requires provision of multiple independent shims to achieve the desired standoff dimension of the vice, multiple shims of differing thicknesses to provide for minute adjustment of the standoff dimension, and/or shims having different areas to provide adequate support for the vice. Elimination of the use of shims and alternate provision of movement in the third axis is therefore desirable.

SUMMARY

This section provides a general summary of the disclosure, and is not a comprehensive disclosure of its full scope or all of its features.

According to several embodiments, a precision leveling vice includes a vice assembly having a fixed jaw, and a moving jaw moved toward the fixed jaw to frictionally retain a member and away from the fixed jaw to release the member. A swivel plate having the vice assembly connected to the swivel plate. A fixture plate positioned oppositely about the swivel plate with respect to the vice assembly. A pivot pin positioned between the swivel plate and the fixture plate permits the swivel plate and vice assembly to together move in a rocking motion with respect to the fixture plate by rotation about the pivot pin.

According to additional embodiments, a precision leveling vice includes a vice body having a fixed jaw and an opposed vice body end wall. A moving jaw is moved toward the fixed jaw to frictionally retain a member and away from the fixed jaw to release the member. A swivel plate has the vice assembly connected to the swivel plate. A fixture plate is positioned oppositely about the swivel plate with respect to the vice assembly. A pivot pin is positioned in a partial circular slot created in each of the swivel plate and the fixture plate permitting the swivel plate and vice assembly to together move in a rocking motion with respect to the fixture plate by rotation about the pivot pin. First and second adjustment fasteners are individually positioned through apertures at opposite ends of the swivel plate and are threadably engaged with the fixture plate. Opposite axial rotation of the first and second adjustment fasteners causes a head of one of the first or second adjustment fasteners to contact the swivel plate inducing the rocking motion.

According to further embodiments, a precision leveling vice system includes a vice body having a fixed jaw and an opposed vice body end wall. A moving jaw moves toward the fixed jaw to frictionally retain a member and away from the fixed jaw to release the member. A swivel plate has the vice assembly connected to the swivel plate. A fixture plate is positioned oppositely about the swivel plate with respect to the vice assembly and in direct contact with a machining device table surface. The fixture plate is horizontally movable with respect to the table surface by loosening fasteners inserted through elongated apertures of the fixture plate and threadably engaged with the table surface. A pivot pin is positioned in a partial circular slot created in each of the swivel plate and the fixture plate permitting the swivel plate and vice assembly to together move in a rocking motion with respect to the fixture plate by rotation about the pivot pin.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 4 is a top plan view of a vice assembly of the present disclosure;

FIG. 5 is a side elevational perspective view of the vice assembly of FIG. 4; and FIG. 6 is a partial cross sectional front elevational view taken at section 6 of FIG. 4.

Corresponding reference numerals indicate corresponding parts throughout the several views of the drawings.

DETAILED DESCRIPTION

Example embodiments will now be described more fully with reference to the accompanying drawings.

Figure 1:
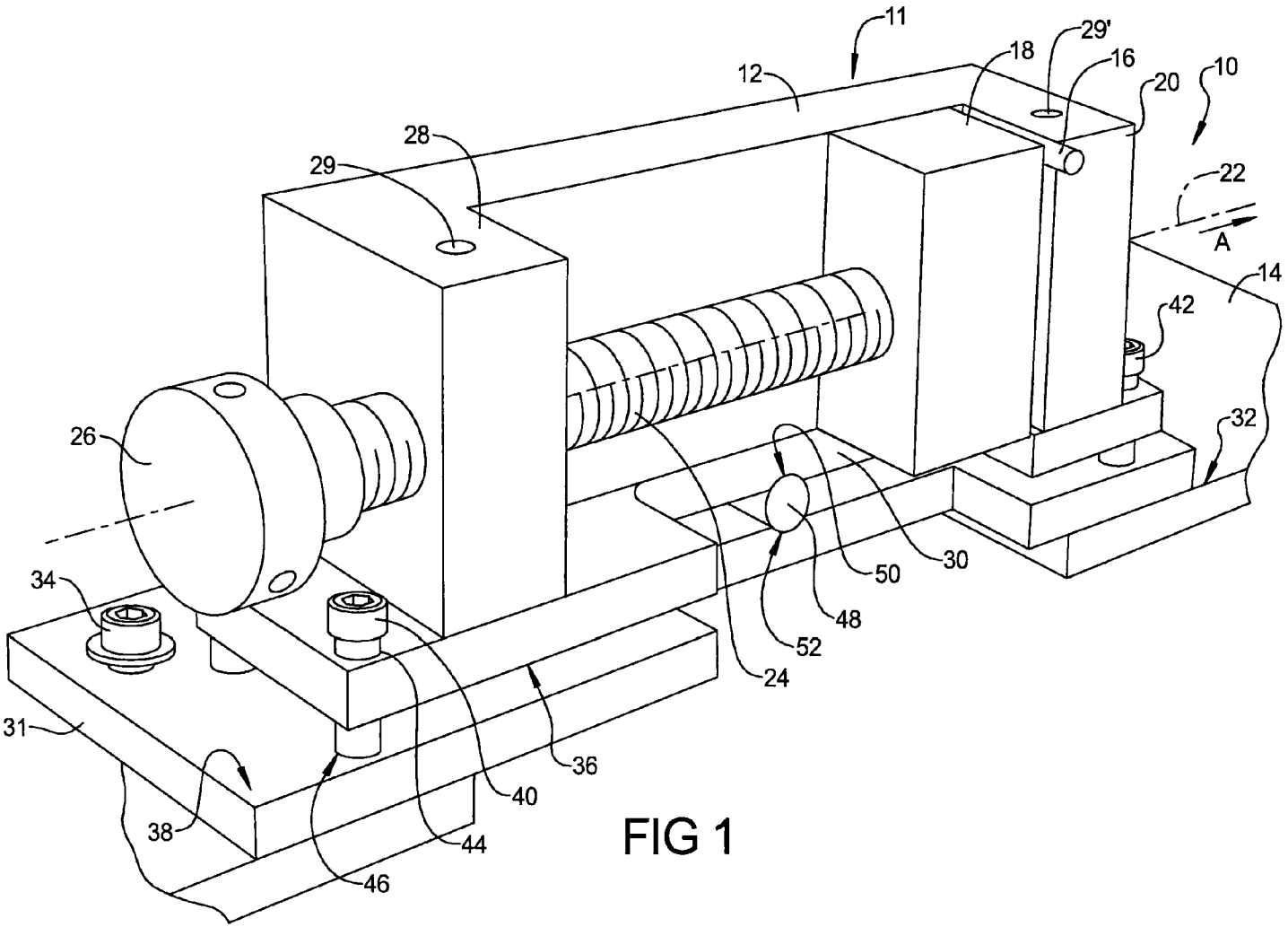
FIG. 1 is a front elevational perspective view of a precision leveling vice system of the present disclosure.

Referring to FIG. 1, a precision leveling vice system 10 includes a vice assembly 11 including a vice body 12. Vice assembly 11 is releasably fixed or fastened to a table 14 of a machining device. Vice assembly 11 is used to releasably retain a member 16 and includes a moving jaw 18. Vice body 12 includes a fixed jaw 20, with member 16 frictionally retained between moving jaw 18 and fixed jaw 20 for a machining operation. The moving jaw 18 is displaceable toward or away from fixed jaw 20 by axial translation with respect to a longitudinal axis 22 of a screw 24 connected to moving jaw 18, such that displacement of moving jaw 18 in a direction "A" frictionally engages member 16 between moving jaw 18 and fixed jaw 20. An opposite rotation of screw 24 displaces moving jaw 18 away from fixed jaw 20 to release member 16.

Screw 24 is manually rotated through the use of a vice handle 26. Screw 24 is threadably received in a vice body wall 28 of vice body 12, oppositely positioned with respect to fixed jaw 20. Rotation of screw 24 displaces moving jaw 18 with respect to vice body wall 28. Vice body wall 28 and fixed jaw 20 each include a threaded aperture 29, 29' which individually receive a threaded fastener (not shown) to releasably fix vice body 12 to a swivel plate 30. A fixture plate 31 is positioned oppositely about the swivel plate 30 with respect to the vice assembly 11. Swivel plate 30 is connected for example by releasably fastening to fixture plate 31. Fixture plate 31 is directly received on a table upper surface 32 of table 14 and releasably fastened using a plurality of fasteners 34. A swivel plate lower surface 36 is spatially separated from a fixture plate upper surface 38 and adjustably spaced using a plurality of first swivel plate jack fasteners 40 and a plurality of second swivel plate jack fasteners 42. Each of the first and second swivel plate jack fasteners 40, 42 are threadably received in individual ones of a plurality of threaded apertures 44 extending through swivel plate 30. A fastener end face 46 of each of the first and second swivel plate jack fasteners 40, 42 contacts the fixture plate upper surface 38 such that contact by the fastener end faces 46 of the first and second swivel plate jack fasteners 40, 42 stabilizes the orientation of swivel plate 30 with respect to table fixture plate 31.

A spacing or gap between swivel plate 30 and fixture plate 31 is also determined by a diameter of a pivot pin 48 which is received in each of a first partial circular slot 50 created in swivel plate 30 and a second partial circular slot 52 created in fixture plate 31. Each of the swivel plate 30 and the fixture plate 31 include one of the partial circular slots each aligned parallel with a longitudinal axis of the pivot pin 48 and each having a curvature substantially matching a diameter of the pivot pin 48 such that the swivel plate 30 is rotatable about the pivot pin 48 with respect to the fixture plate 31 with no horizontal displacement of the pivot pin 48. First and second partial circular slots 50, 52 are therefore coaxially aligned with each other. Pivot pin 48 is frictionally retained within both first and second partial circular slots 50, 52 to permit a rocking motion of opposed ends 51*a*, 51*b* of swivel plate 30 with respect to fixture plate 31 thereby providing an additional axis of movement for member 16. Pivot pin 48 positioned within first and second partial circular slots 50, 52 therefore provides a rocking means to rotate or rock the swivel plate with vice assembly 11 connected thereto with respect to fixture plate 31. To ensure vice system 10 can be used in an EDM machining system which requires the retention components to provide an electrically conductive path, a material of individual ones of the vice body 12, swivel plate 30, fixture plate 31 and pivot pin 48 can each be electrically conductive.

Referring to FIG. 2 and again to FIG. 1, the position of fixture plate 31 is adjustable on table 14 by sliding displacement of fixture plate 31. To permit sliding displacement, fasteners 34 are loosened and therefore moveable in elongated slots 53 created in fixture plate 31. Once the desired position of fixture plate 31 is established, fasteners 34 are tightened. Vice assembly 11 further includes first and second rocking adjustment fasteners 54, 54' (only first adjustment fastener 54 is visible in this view) positioned between each of the first swivel plate jack fasteners 40, 40' and also between each of the second swivel plate jack fasteners 42, 42' (only second swivel plate jack fastener 42' is visible in this view). Fasteners 54, 54' freely extend through elongated apertures created in swivel plate 30 and are threadably engaged in threaded apertures of fixture plate 31. Opposite axial rotation of fasteners 54, 54' moves the opposed ends 51*a*, 51*b* of swivel plate 30 in opposite individual rocking directions with respect to pivot pin 48 shown and described in reference to FIG. 1.

Figure 2:
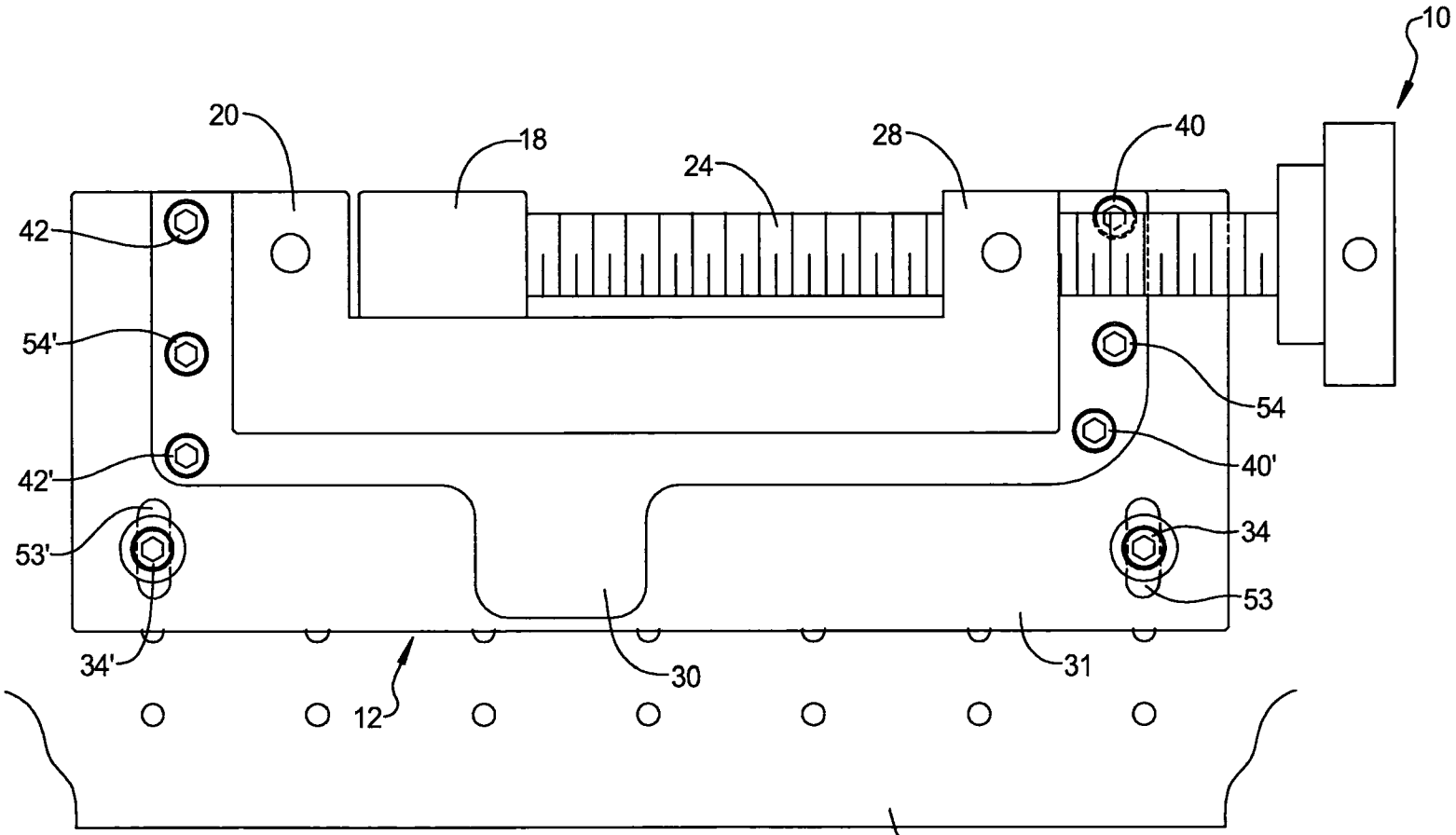
FIG. 2 is a rear elevational perspective view of the precision leveling vice system of FIG. 1.
Figure 3:
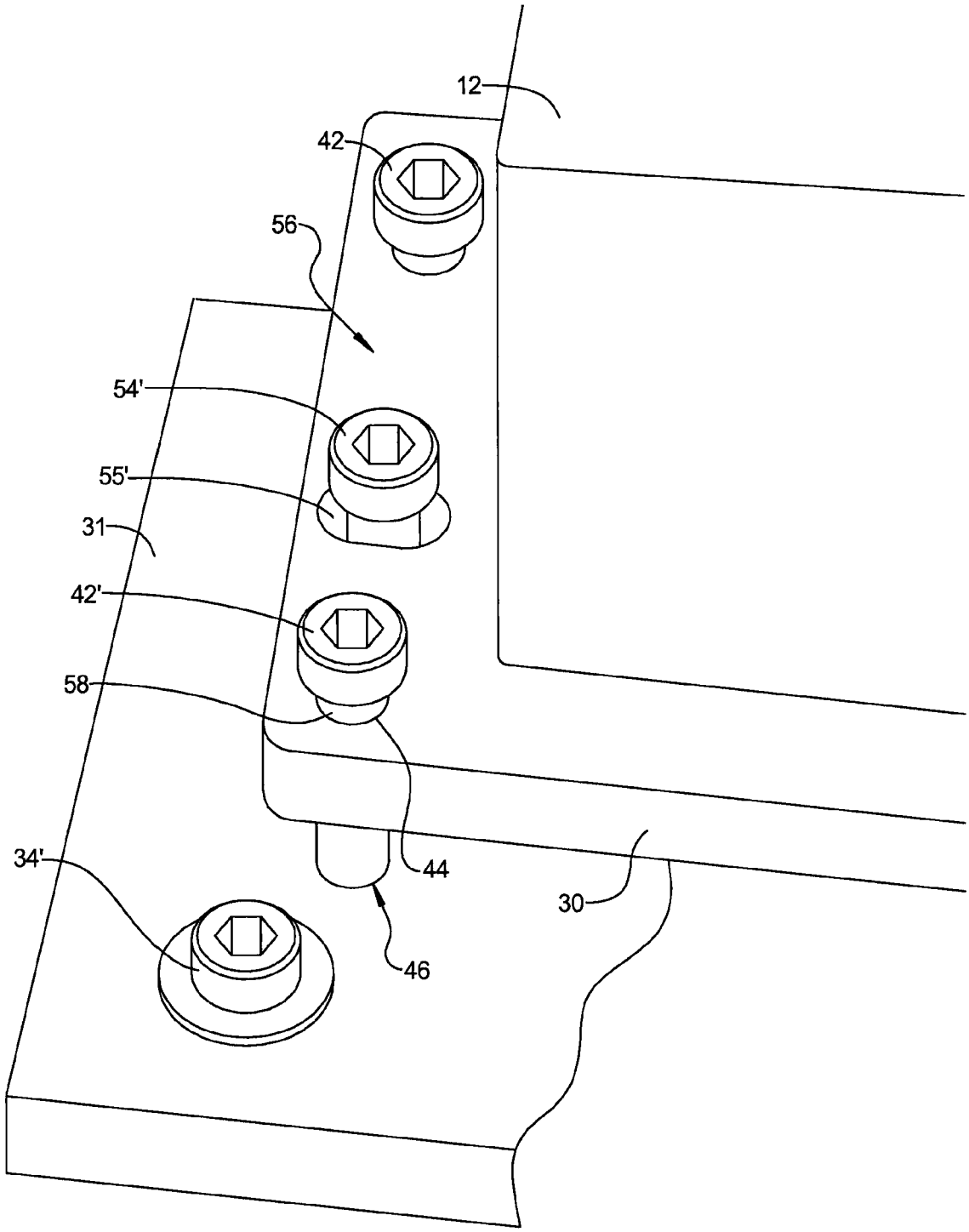
FIG. 3 is a rear elevational perspective view of area 3 of FIG. 2.

Referring to FIG. 3 and again to FIGS. 1 and 2, each shank of first and second fasteners 54, 54' is individually slidably received in an elongated aperture 55 created at opposite ends of swivel plate 30. Elongated apertures 55 permit the rocking motion of swivel plate 30 with respect to fixture plate 31 during adjustment of swivel plate 30. Contact between the heads of fasteners 54, 54' and a swivel plate upper surface 56 prevents further rotation of swivel plate 30 about pivot pin 48 with respect to fixture plate 31. Once contact between the heads of fasteners 54, 54' with swivel plate upper surface 56 is established, the fastener end face 46 of each of the first swivel plate jack fasteners 40, 40' (shown) and second swivel plate jack fasteners 42, 42' (not visible in this view) are rotated into contact with fixture plate 31, having a threaded shank 58 of each of the swivel plate jack fasteners 40, 40', 42, 42' threadably received in individual ones of the threaded apertures 44 created in swivel plate 30.

Fasteners 54, 54' induce the rocking motion and further provide end-to-end stability of swivel plate 30, while first and second swivel plate jack fasteners 40, 40', 42, 42' provide side-to-side stability of swivel plate 30 after the rocked position of swivel plate 30 is set by contact of the fastener heads of fasteners 54, 54' with swivel plate 30. First and second swivel plate jack fasteners 40, 40', 42, 42' therefore provide a swivel plate stabilizing means. Fasteners 54, 54' therefore provide a rocking adjustment means to control an amount of rock or angle of rotation of swivel plate 30 with respect to fixture plate 31. Swivel plate 30 is nominally oriented parallel to fixture plate 31 and can be rotated or rocked with respect to the longitudinal axis of pivot pin 48 anywhere from the parallel position to a maximum rocked position wherein one of the opposed ends 51*a* or 51*b* of swivel plate 30 contacts the fixture plate upper surface 38 of fixture plate 31. A greater or lesser angle of rocking defining the maximum rocked position can also be provided by increasing or decreasing the diameter of pivot pin 48.

Referring to FIG. 4 and again to FIG. 2, vice assembly 11 is rotatable with respect to an XY rotational arc 60 using the previously described fasteners 34 movable in the elongated slots 53 of fixture plate 31. The member 16 is therefore adjustable with respect to XY rotational arc 60 by horizontal displacement of fixture plate 31 providing a first axis of movement for member 16 to adjust its position prior to machining.

Referring to FIG. 5, the member 16 received between moving jaw 18 and fixed jaw 20 is further rotatable in a UV-X rotational arc 60 by loosening and subsequent tightening of moving jaw 18 with respect to member 16. UV-X arc of rotation 62 therefore provides a second axis of movement for member 16 to adjust its position prior to machining.

Referring to FIG. 6, the positioning of pivot pin 48 within each of the partial circular slots 50, 52 permits swivel plate 30 to rotate with respect to a pivot pin longitudinal axis 66 providing a UV-Y arc of rotation 64 for swivel plate 30 and vice assembly 11 with respect to fixture plate 31. A gap 68 between swivel plate 30 and fixture plate 31 will vary from end-to-end of swivel plate 30 with respect to fixture plate 31 by rotation of the vice assembly 11. Gap 68 is determined by a diameter 70 of pivot pin 48 and the depth of each of the partial circular slots 50, 52. A gap spacing "B" at a first location between swivel plate 30 and fixture plate 31 can therefore be varied with respect to a gap spacing "C" at a second end of swivel plate 30 with respect to fixture plate 31 by rotation with respect to pivot pin 48. Co-rotation of swivel plate 30 and vice assembly 11 with respect to UV-Y arc of rotation 64 therefore provides a third axis of movement for positioning member 16 prior to machining.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A precision leveling vice, comprising:

a vice assembly having a fixed jaw, and a moving jaw moved toward the fixed jaw to frictionally retain a member and away from the fixed jaw to release the member;

a swivel plate having the vice assembly connected to the swivel plate;

a fixture plate positioned below the swivel plate with respect to the vice assembly;

a pivot pin positioned between the swivel plate and the fixture plate permitting the swivel plate and vice assembly to together move in a rocking motion with respect to the fixture plate by rotation about the pivot pin, and first and second adjustment fasteners, each freely received through one of first and second elongated apertures created in the swivel plate and threadably engaged with the fixture plate, wherein opposite axial rotation of the first and second adjustment fasteners causes a head of one of the first or second adjustment fasteners to contact the swivel plate inducing the rocking motion.

2. The precision leveling vice of claim 1, wherein the first and second elongated apertures are positioned proximate to opposite first and second ends of the swivel plate and oppositely about the pivot pin.

3. The precision leveling vice of claim 1, further including a plurality of first swivel plate jack fasteners individually threadably engaged with the swivel plate proximate a first end of the swivel plate, and a plurality of second swivel plate jack fasteners individually threadably engaged with the swivel plate proximate a second end of the swivel plate, the first and second swivel plate jack fasteners providing side-to-side stability of the swivel plate with respect to the fixture plate.

4. The precision leveling vice of claim 1, wherein each of the first and second swivel plate jack fasteners includes a fastener end face contacting a fixture plate upper surface after the first and second adjustment fasteners induce the rocking motion of the swivel plate to a swivel plate desired rocked position.

5. The precision leveling vice of claim 1, wherein the rocking motion of the swivel plate creates a longitudinal arc of rotation of the member, the fixture plate being horizontally movable to create a first axis of adjustment for the member, the member being rotatable between the moving and fixed jaws to create a second axis of adjustment for the member, and the longitudinal arc of rotation creating a third axis of adjustment for the member.

6. The precision leveling vice of claim 1, wherein the vice assembly includes a vice body having the fixed jaw spatially separated from a vice body end wall, and a screw threadably received through the vice body end wall and connected to the moving jaw, such that rotation of the screw displaces the moving jaw toward or away from the fixed jaw.

7. The precision leveling vice of claim 1, wherein each of the swivel plate and the fixture plate include a partial circular slot each aligned parallel with a longitudinal axis of the pivot pin and each having a curvature substantially matching a diameter of the pivot pin such that the swivel plate is rotatable about the pivot pin with respect to the fixture plate with no horizontal displacement of the pivot pin.

8. A precision leveling vice, comprising:

a vice body having a fixed jaw and an opposed vice body end wall;

a moving jaw moved toward the fixed jaw to frictionally retain a member and away from the fixed jaw to release the member;

a swivel plate having the vice body connected to the swivel plate;

a fixture plate positioned oppositely about the swivel plate with respect to the vice body;

a pivot pin positioned in a partial circular slot created in each of the swivel plate and the fixture plate permitting the swivel plate and vice assembly to together move in a rocking motion with respect to the fixture plate by rotation about the pivot pin; and first and second adjustment fasteners individually positioned through apertures at opposite ends of the swivel plate and threadably engaged with the fixture plate, opposite axial rotation of the first and second adjustment fasteners causes a head of one of the first or second adjustment fasteners to contact the swivel plate inducing the rocking motion.

9. The precision leveling vice of claim 8, wherein the first and second adjustment fasteners are each freely received through one of a first and second elongated aperture individually created in the swivel plate such that a shank of the first and second adjustment fasteners displaces in the elongated aperture permitting the rocking motion.

10. The precision leveling vice of claim 9, further including first and second swivel plate jack fasteners positioned proximate to each of the first and second adjustment fasteners, each threadably connected to the swivel plate and extending by axial rotation to contact the fixture plate to stabilize the swivel plate with respect to the fixture plate following completion of the rocking motion.

11. The precision leveling vice of claim 8, wherein a gap is created between the swivel plate and the fixture plate when the pivot pin is positioned in the partial circular slot of each of the swivel plate and the fixture plate.

12. The precision leveling vice of claim 11, wherein a first gap spacing between the swivel plate and the fixture plate at a first end of the swivel plate can vary from a second gap spacing between the swivel plate and the fixture plate at a second end of the swivel plate by the opposite axial rotation of the first and second adjustment fasteners.

13. The precision leveling vice of claim 8, wherein a material of each of the vice body, swivel plate, fixture plate and pivot pin is electrically conductive.

14. A precision leveling vice system, comprising: a vice body having a fixed jaw and an opposed vice body end wall; a moving jaw moved toward the fixed jaw to frictionally retain a member and away from the fixed jaw to release the member; a swivel plate having the vice assembly body connected to the swivel plate; a fixture plate positioned below the swivel plate with respect to the vice body and in direct contact with a machining device table surface, the fixture plate horizontally movable with respect to the table surface by loosening fasteners inserted through elongated apertures of the fixture plate and threadably engaged with the table surface; first and second adjustment fasteners individually positioned through apertures at opposite ends of the swivel plate and threadably engaged with the fixture plate, opposite axial rotation of the first and second adjustment fasteners causes a head of one of the first or second adjustment fasteners to contact the swivel plate inducing a rocking motion, and a pivot pin positioned in a partial circular slot created in each of the swivel plate and the fixture plate permitting the swivel plate and vice assembly body to together move in the rocking motion with respect to the fixture plate by rotation about the pivot pin.

15. The precision leveling vice system of claim 14, wherein the rocking motion of the swivel plate creates a longitudinal arc of rotation of the member, the fixture plate being horizontally movable with respect to the machining device table surface to create a first axis of adjustment for the member, the member being rotatable between the moving and fixed jaws to create a second axis of adjustment for the member, and the longitudinal arc of rotation creating a third axis of adjustment for the member.

16. The precision leveling vice system of claim 14, further including a first swivel plate jack fastener threadably engaged with the swivel plate proximate a first end of the swivel plate, and a second swivel plate jack fastener threadably engaged with the swivel plate proximate a second end of the swivel plate, the first and second swivel plate jack fasteners contacting the fixture plate providing side-to-side stability of the swivel plate with respect to the fixture plate.

17. The precision leveling vice system of claim 14, wherein the partial circular slot of each of the swivel plate and the fixture plate are aligned parallel with a longitudinal axis of the pivot pin and each having a curvature substantially matching a diameter of the pivot pin such that the swivel plate is rotatable about the pivot pin with respect to the fixture plate without horizontal displacement of the pivot pin.

18. The precision leveling vice system of claim 14, wherein the fixture plate includes at least two elongated apertures each receiving a fastener threadably engaged to a table defining the machining device table surface to fastenably connect the fixture plate to the table surface, the fasteners movable within the elongated apertures to permit the fixture plate to be moved horizontally.

* * * * *

UNITED STATES PATENT AND TRADEMARK OFFICE

CERTIFICATE OF CORRECTION

PATENT NO. : 8,678,364 B2
APPLICATION NO. : 13/070301
DATED : March 25, 2014
INVENTOR(S) : Matthew L. Watts It is certified that error appears in the above-identified patent and that said Letters Patent is hereby corrected as shown below:

In the Claims:

Col. 8, Claim 14, line 11, after "vice" delete "assembly";

Col. 8, Claim 14, line 25, after "vice" delete "assembly".

Signed and Sealed this
Fifteenth Day of July, 2014

Michelle K. Lee

Michelle K. Lee
*Deputy Director of the United States Patent and Trademark Office*